United States Patent [19]

Cochrane et al.

[11] 4,077,743

[45] Mar. 7, 1978

[54] COMPRESSION MACHINERY METHOD AND APPARATUS

[75] Inventors: W. Winston Cochrane; Carl H. Geary, both of Greensburg, Pa.; Derek Fothergill, Northfleet, England

[73] Assignee: Carrier Corporation, Syracuse, N.Y.

[21] Appl. No.: 759,694

[22] Filed: Jan. 17, 1977

[51] Int. Cl.[2] ..... F04B 23/04

[52] U.S. Cl. ..... 417/53; 417/62; 417/243

[58] Field of Search ..... 417/243, 53, 62, 247, 417/248, 253, 286, 428

[56] References Cited

U.S. PATENT DOCUMENTS

| | | | |
|---|---|---|---|
| 3,096,927 | 7/1963 | Wahl | 417/243 X |
| 3,152,753 | 10/1964 | Adams | 417/243 X |
| 3,216,648 | 11/1965 | Ford | 417/243 X |
| 3,496,960 | 2/1970 | Hughes | 417/62 X |
| 3,988,897 | 11/1976 | Strub | 417/243 X |

*Primary Examiner*—Carlton R. Croyle
*Assistant Examiner*—R. E. Gluck
*Attorney, Agent, or Firm*—J. Raymond Curtin; Barry E. Deutsch

[57] ABSTRACT

Compression machinery including a low pressure stage, a high pressure stage and a single aftercooler, further includes a bypass path through which fluid discharged from the low pressure stage is directed about the high pressure stage. The bypass path includes the aftercooler. Upon activation of the high pressure stage, a portion of the fluid flowing through the bypass path is diverted to the suction side of the high pressure stage. As a result of continued operation of the high pressure stage, the flow of fluid through the bypass path is decreased and the flow of fluid through the high pressure stage is increased.

9 Claims, 1 Drawing Figure

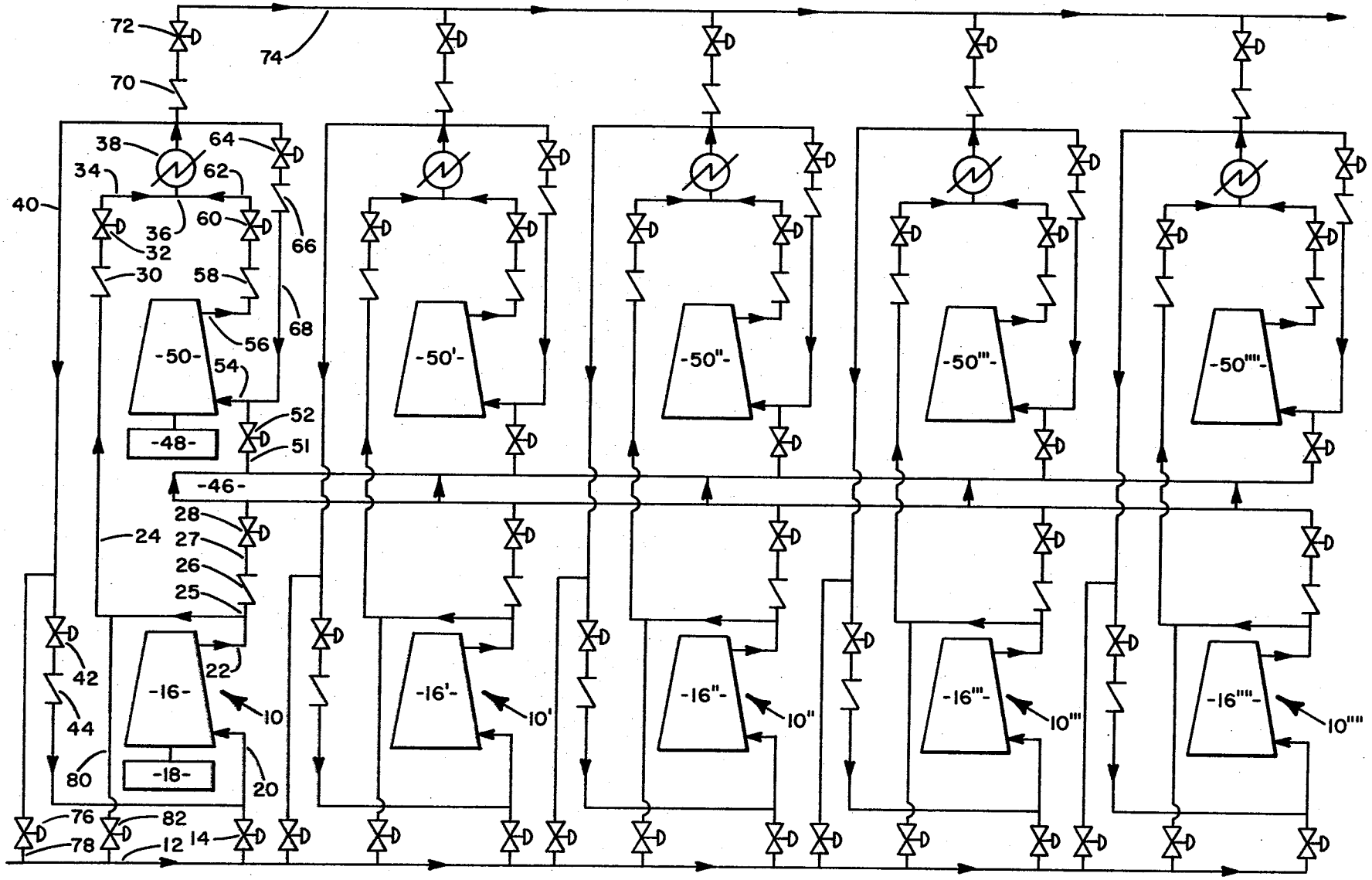
-50'-
-50''-
-50'''-
-50''''-
-16'-
-16''-
-16'''-
-16''''-
10'
10''
10'''
10''''
-46-
-50-
-48-
-16-
-18-
10
12
14
20
22
24
25
26
27
28
30
32
34
36
38
40
42
44
51
52
54
56
58
60
62
64
66
68
70
72
74
76
78
80
82

COMPRESSION MACHINERY METHOD AND APPARATUS

BACKGROUND OF THE INVENTION

This invention relates to compression machinery, and in particular, to a method and associated apparatus to accomplish stable starting and shutdown of multi-stage compression equipment employing a single aftercooler.

In multiple stage compression machinery of the type wherein each compression stage is sequentially placed in operation only after the next lower stage has been operating at design conditions for a predetermined period of time, discharge gas coolers or aftercoolers are required to reduce the temperature of fluid discharged from each stage. As is well recognized, a substantial reduction or elimination of the heat developed by compression of the fluid is particularly important when the fluid is recirculated from the discharge side to the suction side of the compression stage. Heretofore, it has commonly been the practice to have separate gas coolers for each separate compression stage.

In starting multi-stage compression machinery, the lowest pressure stage is initially activated. The fluid discharged therefrom is directed through a bypass or recirculation path including the aftercooler. The low pressure stage is operated in this manner for a predetermined time interval to insure that all mechanical parts of the equipment are functioning properly and to further permit the unit to thermally expand at minimal load conditions.

When the next higher pressure stage is started, the fluid discharged therefrom is directed through a bypass or recirculation path also including the gas cooler. A portion of the fluid directed through the low pressure stage bypass path is now directed to the suction side of the operating high pressure stage. As flow requirements of the high pressure stage are increased, an increased proportion of the fluid discharged from the low pressure stage is diverted to the suction side of the high pressure stage. The increased flow to the high pressure stage and concurrent decreased flow through the low pressure stage bypass path should be accomplished in an efficient manner to avoid a loss of operating efficiency and to prevent the creation of operating problems, as for example surge conditions. Additionally, it is important that in installations having a number of multi-stage machines operating concurrently to handle a single load, that either of the stages of a single machine can be independently stopped without interfering with the operation of the remaining stages.

SUMMARY OF THE INVENTION

It is an object of this invention to employ a single aftercooler during starting conditions for at least two stages of multi-stage fluid compression machinery.

It is a further object of this invention to automatically divert a portion of the flow of fluid passing through a first bypass path to the suction side of a high pressure stage.

It is yet another object of this invention to divert an ever increasing proportion of the flow of fluid to the high pressure stage as the flow requirements of the high pressure stage increase.

It is a further object of this invention to terminate operation of one stage without adversely affecting the performance of the stages still maintained in service.

These and other objects of the present invention are attained in multi-stage fluid compression machinery having at least a low pressure stage, a high pressure stage, and a single aftercooler comprising first conduit means defining a bypass flow path to deliver fluid discharged from the low pressure stage through the cooler and then to the suction side of the low pressure stage. When the high pressure stage is activated, a portion of the fluid discharged from the low pressure stage is diverted to the suction side of the high pressure stage. The remaining portion of the fluid continues to pass through the bypass flow path. As flow requirements of the high pressure stage increase, the quantity of fluid passing through the bypass flow path is reduced concurrently with an increase in the quantity of fluid directed to the suction side of the high pressure stage.

If it is desired to terminate operation of a low pressure stage while maintaining the high pressure stage in service, a hog gas bypass line is opened to provide a flow from the discharge from the low pressure stage back to the suction manifold. This gas is delivered to the suction side of the remaining low pressure stages. By raising the temperature of the gas in the suction manifold in this manner, the specific volume of the gas is similarly increased. Assuming the mass flow rate remains constant, the quantity of gas, in cubic feet per minute (cfm), delivered to the suction side of the remaining low pressure compressor stages will increase thereby lowering the discharge pressure therefrom. The decreased discharge pressure will be sensed and a signal generated to increase the speed of the remaining compressors to effectively handle the increased load thereon.

BRIEF DESCRIPTION OF THE DRAWING

The single FIGURE of the drawing schematically illustrates multi-stage compression machinery embodying the present invention.

DESCRIPTION OF THE PREFERRED EMBODIMENT

Referring now to the single FIGURE of the drawing, there is schematically illustrated compression machinery embodying the present invention. The present invention is particularly suitable for use in applications wherein, during startup and shutdown of the machinery it is desirable to recirculate the fluid being compressed.

The fluid to be compressed, for example a gas, is supplied via main conduit 12 from a suitable source thereof, for example a well (not shown). Conduit 12 delivers the fluid under pressure to the compression machinery string represented in general by reference numeral 10. In the arrangement depicted in the drawing, the system includes a plurality of multi-stage compression machinery strings represented in general by reference numerals 10, 10', 10'', etc. As each individual string of the system is identical, only string 10 will be described in detail. Also, although only two stages are illustrated for each string, the invention contemplates the addition of further stages.

A valve 14 is provided to throttle the flow of fluid passing from conduit 12 through line 20, to the first or low pressure stage 16 of compression machinery string 10. Stage 16 is operably connected to its own prime mover, represented by reference numeral 18. The compressed fluid leaves stage 16 via line 22. Line 22 delivers the compressed fluid to the junction 25 of lines 24 and 27.

A one-way flow control or check valve 26 and a flow regulating valve 28 are disposed in line 27. When valve 28 is in a closed position, the compressed fluid flows through line 24 and thence through valves 30 and 32 to line 34. Valve 30 is a one-way flow control or check valve similar to valve 26, and valve 32 is a flow regulating valve similar in design to valve 28. It is assumed that valves 30 and 32 are in an open state when valve 28 is closed. The fluid passing from line 34 flows to suction 36 of a discharge or gas aftercooler 38. Aftercooler 38 is provided with a heat transfer medium which flows in heat transfer relation with the compressed fluid. The compressed fluid transfers a substantial portion of the heat generated during the compression stage to the heat transfer fluid. The reduction in temperature of the compressed fluid is particularly required when the fluid is being recirculated during startup or shutdown operations.

During initial startup of the compression string, the fluid discharged from cooler 38 is directed through line 40 in communication therewith. Valve 64 disposed in line 68 is closed. Flow control valve 44 and flow regulating valve 42 are placed in the flow path defined by line 40. Line 78 having flow control valve 76 disposed therein defines a bypass path about valves 42 and 44. A portion of the fluid passing through line 40 is returned, via valves 42 and 44, to line 20 for recirculation through compressor 16. Thus, lines 24, 34, 40, and 78, aftercooler 38, and valves 30, 32, 42, 44, and 76 define a bypass flow path about the second or high pressure stage 50 for the fluid discharged from first stage 16 of the compression string. The remaining portion of the fluid flowing through line 40 is directed via valve 76 to conduit 12 "upstream" of throttle valve 14.

After a predetermined time interval, to insure that first stage 16 is functioning without any mechanical problems, flow control valve 28 is opened to permit flow of fluid from line 22 through line 27 and thence into manifold 46. From manifold 46, the fluid passes through a line 51 having a throttle valve 52 disposed therein, through line 54, and thence into the suction side of a second or high pressure stage 50. Compressor stage 50 is independently connected to its own prime mover 48.

The compressed fluid discharged from stage 50 exits via conduit 56 having flow control valve 58 and flow regulating valve 60 disposed therein. The fluid passing through valve 60 is delivered via line 62 to suction 36 of aftercooler 38. The cooler functions to substantially eliminate the heat of compression developed in stage 50.

For a predetermined time interval, it is desirable to maintain stage 50 in an unloaded state to assure there are no mechanical problems. Valve 72 is retained in its closed position and valve 64 in its open position whereby the fluid discharged from aftercooler 38 is directed through line 68 to line 54 for recirculation through high pressure stage 50. The compression machinery further includes line 80 which communicates with line 24. Line 80 has valve 82 disposed therein to control the flow of fluid therethrough. The function of line 80 and valve 82 will be explained in detail hereinafter.

Flow regulating valves 14, 28, 32, 42, 52, 60, 64, 76, and 82 may be manually controlled; however, these valves are preferably automatically sequenced to function in the described manner via pneumatic or electrical signals generated as a result of sensed operating conditions. Automatic operation of the valves in response to sensed operating conditions is considered to be within the skill of the art and a complete explanation thereof is not deemed necessary.

OPERATION

For a better understanding of the compression system heretofore described, the manner in which string 10 is started shall now be explained in detail. For initial startup, gas flowing through main supply conduit 12 is throttled by means of throttle valve 14 to a minimum predetermined pressure. During the initial startup procedure, flow regulating valve 28 is in a closed position and valves 32 and 42 are in an open position. Valves 64 and 72 are also in closed positions.

The fluid compressed by operation of low pressure stage 16 passes from line 22 to line 24. The fluid is thence directed through cooler 38 whereat the heat of compression is removed from the compressed fluid. As valve 72 is closed and valves 42 and 76 are open, the cooled fluid is directed through line 40 back to the suction side of low pressure stage 16, and through line 78 to conduit 12 "upstream" of valve 14.

Stage 16 will continue to operate in the above-described manner for a predetermined time interval. After the predetermined time interval has elapsed, valve 14 is slowly opened to increase the suction pressure to design conditions. Valve 28 then opens and valve 32 is slightly closed to reduce the quantity of fluid being recirculated through line 34. By opening valve 28, a portion of the fluid heretofore directed through line 24 is diverted to pressurize manifold 46, from whence the fluid passes into line 51.

Valve 60 is partially opened to permit fluid discharged from compressor 50 to pass to suction 36 of cooler 38. Valve 60 maintains the pressure "downstream" thereof at the same magnitude as the pressure "downstream" of valve 32. This permits continued flow through lines 24 and 34. Valve 58 prevents any reverse flow through lines 56 and 62. Fluid is delivered from manifold 46 via line 51. Valve 52 throttles the flow of fluid to the suction side of high pressure stage 50 to a predesigned pressure. Valve 64 is opened and valve 72 remains closed to thereby direct the fluid through recirculation line 68 to the suction side of stage 50. At this time, cooler 38 is receiving compressed fluid from both low pressure stage 16, via lines 24 and 34, and high pressure stage 50, via line 62. Thus, only a single aftercooler is required to remove the heat of compression developed in each stage of the multi-stage string 10.

As the discharge pressure of the high pressure stage is increased as a result of increased suction pressure, additional flow of fluid is directed from first stage 16 to manifold 46 to maintain pressure conditions therein. This requires a further closing of valve 32. As valve 60 opens further to increase the pressure downstream thereof, this downstream pressure will exceed the pressure downstream of valve 32, terminating flow through line 34 to cooler 38. Valve 30 will prevent any reverse flow through lines 24 and 34. Thus, as flow requirements of the high pressure stage increase, the flow through bypass path 24 and 34 is automatically terminated, thereby delivering all the fluid discharged from stage 16 to stage 50.

The recycle flow from high pressure unit 50 proceeds through cooler 38 and is throttled back to the suction of the high pressure stage through control valve 64. Additional flow will pass through line 40 back to the suction side of low pressure stage 16 or via line 78, to conduit 14. After a predetermined period has elapsed to insure that the high pressure stage is properly functioning, valve 72 is gradually opened and valves 64 and 76 are closed to permit passage of the compressed fluid through discharge line 74. Valves 42 and 64 may be maintained slightly open; however, the flow therethrough will be reduced to meet discharge requirements as determined by the demand placed on line 74. Each of the remaining stages, 10' etc., will be started in an identical manner.

As an additional feature, due to the use of manifold 46 and the utilization of separate prime movers for each stage of each compressor string, the operation of any one of the high pressure stages or low pressure stages of any one string may be separately discontinued without requiring the stoppage of the other stage of the particular string. For example, stage 16 may be shutdown independently from stage 50. The reverse is also true. If stage 16 is stopped, a pressure sensor in manifold 46 transmits a signal to the prime movers for the remaining low pressure stages 16' etc., to increase the speed thereof which increases the flow therefrom. If this satisfies the flow requirements of the four high pressure stages 50, 50', etc., they will remain at their same operating speed. However, if required the speed thereof may be reduced to obtain stable operation. Similarly, if any high pressure stage is removed, the three remaining high pressure stages will accept flow from all four low pressure stages. If required, the speed of the three remaining high pressure stages may be increased for stable operation. Assuming it is desired to remove stage 16 from operation, valve 28 is closed, as are valves 32, 42, and 78. Valve 14 remains open. Valve 82 in line 80 is opened. Thus, the discharge of relatively hot fluid from compression stage 16 will be directed, via line 80 and valve 82 to inlet line 14. Thus, the temperature of the fluid flowing to the remaining low pressure stages 16', etc. will be increased. By raising the temperature of the fluid in suction line 12, the specific volume of the fluid is similarly increased.

If the mass flow rate remains constant, the quantity of fluid in cfm delivered to the inlet to the remaining low pressure stages 16', etc. will increase, thereby lowering the discharge pressure therefrom. The reduction in discharge pressure from the remaining low pressure stages will be sensed and a signal generated to increase the speed of the remaining stages to efficiently and effectively handle the increased load thereon. After stable operation has been attained, low pressure stage 16 may be stopped.

The foregoing arrangement permits a single aftercooler to accept the flow from more than one stage of a multi-stage compression machine. In addition, the flow of compressed fluid from the low pressure stage through a bypass circuit is automatically terminated as the flow requirements of the high pressure stage increase. This provides for efficient and stable operation of the compression machinery. Further, the termination of operation of one or more stages may be effectively accomplished without necessitating the stoppage of the entire compression string.

While a preferred embodiment of the present invention has been described and illustrated, the invention should not be limited thereto, but may be otherwise embodied within the scope of the following claims.

What is claimed is:

1. A method of operating compression machinery having at least a low pressure stage, a high pressure stage, and a single aftercooler comprising the steps of:

starting the low pressure stage while maintaining the high pressure stage inactive;

directing the fluid discharged from the low pressure stage serially through a first bypass path about the high pressure stage, through the aftercooler and back to the suction of the low pressure stage;

activating the high pressure stage;

delivering a first portion of the fluid flow discharged from the low pressure stage to the suction side of the high pressure stage while continuing to direct the remaining portion of the fluid flow through the bypass path;

bypassing the fluid discharged from the high pressure stage through the aftercooler back to the suction side of the high pressure stage; and reducing the flow of fluid through the first bypass path as the first portion of the fluid flow is increased due to increased flow requirements resulting from operation of the high pressure stage.

2. A method in accordance with claim 1 further comprising the step of:

initially throttling the flow of fluid discharged from the high pressure stage to maintain the pressure of the fluid entering the aftercooler from the high pressure stage at the same level as the pressure of the fluid entering the cooler from the low pressure stage.

3. A method in accordance with claim 2 wherein the reduced flow of fluid through the first bypass path is obtained as a result of an increase in the pressure of the fluid at the entrance to the aftercooler.

4. A method in accordance with claim 1 further comprising the step of:

terminating the flow of fluid from the low pressure stage to the high pressure stage while maintaining the low pressure stage operative; and circulating the fluid discharged from the low pressure stage directly to a suction line delivering fluid to at least one additional low pressure stage to increase the temperature and specific volume of the fluid.

5. Compression machinery including at least a low pressure stage, a high pressure stage and a single aftercooler comprising:

first conduit means defining a bypass flow path to deliver fluid discharged from the low pressure stage serially through the aftercooler and to the suction side of the low pressure stage;

flow directing means to direct a first portion of the fluid discharged from the low pressure stage to the suction side of said high pressure stage, the remaining portion of the fluid being directed to the bypass flow path; and flow regulating means to reduce the flow of fluid through the bypass flow path and to increase the flow of fluid to the high pressure stage as a result of continued operation of the high pressure stage.

6. Compression machinery in accordance with claim 5 further including a second bypass flow path to deliver fluid discharged from the high pressure stage serially through the aftercooler to the suction side of the high pressure stage.

7. Compression machinery in accordance with claim 6 wherein the flow regulating means includes throttle valve means located between the high pressure stage discharge nd the entrance to the aftercooler to regulate the pressure of the fluid delivered to the cooler from the high pressure stage.

8. Compression machinery in accordance with claim 5 further including:

at least a second low pressure stage and at least a second high pressure stage in communication therewith; and a second bypass flow path communicating the discharge from the first low pressure stage to the suction side of the first and second low pressure stages to increase the temperature and specific volume of the fluid supplied to the suction side of said low pressure stages.

9. A method of operating compression machinery having at least a low pressure stage, a high pressure stage and a single aftercooler comprising the steps of:

starting the low pressure compression stage while maintaining the high pressure stage inactive;

initially directing all the fluid discharged from the low pressure stage through a bypass path including the aftercooler back to the suction side of the low pressure stage;

activating the high pressure stage;

delivering a first portion of the fluid discharged from the low pressure stage to the suction side of the high pressure stage for compression by operation of the high pressure stage;

delivering the remaining portion of the fluid discharged from the low pressure stage through the bypass path about the high pressure stage;

directing fluid discharged by the high pressure stage to the aftercooler; and discontinuing the flow of fluid through the bypass path about the high pressure stage when the discharge pressure at the entrance to the aftercooler exceeds the pressure of the fluid developed in the bypass path.

* * * * *